US005522472A

United States Patent [19]

Shuman, Jr. et al.

[11] Patent Number: 5,522,472

[45] Date of Patent: Jun. 4, 1996

[54] FALL PROTECTION SYSTEM FOR BRIDGE CONSTRUCTION

[76] Inventors: Jack W. Shuman, Jr., 2034 Trudie Dr., Rancho Palos Verdes, Calif. 90274; John D. Cluff, 2417 Desire, Rowland Heights, Calif. 91748

[21] Appl. No.: 333,726

[22] Filed: Nov. 3, 1994

[51] Int. Cl.[6] ..... A62B 37/00

[52] U.S. Cl. ..... 182/3; 256/1

[58] Field of Search ..... 182/3, 113, 45; 256/59, 1

[56] References Cited

U.S. PATENT DOCUMENTS 5,297,651 3/1994 Vandeline ..... 182/3

5,409,195 4/1995 Strickland ..... 182/3 X

*Primary Examiner*—Alvin C. Chin-Shue

*Attorney, Agent, or Firm*—Roy A. Ekstrand

[57] ABSTRACT

A fall protection system for bridge construction includes a plurality of generally T-shaped cable supports securable to the concrete support columns of a bridle or overpass during construction. A plurality of cables are coupled between the T-shaped supports which receive a corresponding plurality of slidable safety belt attachments for use in securing a plurality of construction workers wearing appropriate safety harnesses to the overhead cables. Embodiments are shown in which the T-shaped cable supports are secured either to the extending reinforcement bar cages of each concrete support column or, alternatively, received directly within a suitably formed closed end bore within the concrete pier of the support column.

10 Claims, 3 Drawing Sheets

FALL PROTECTION SYSTEM FOR BRIDGE CONSTRUCTION

FIELD OF THE INVENTION

This invention relates generally to fall protection systems and particularly to those utilized during construction of bridges, overpasses or the like.

BACKGROUND OF THE INVENTION

One of the most impressive aspects of modern industrialized nations is found in the vast network of interstate freeways and expressways which often seem to stretch endlessly across the countryside. Perhaps the most essential element of such networks is the provision of the various interchanges and overpasses or the like which interconnect and cross couple the high speed freeways and expressways. Such interchanges and overpasses frequently utilize a plurality of bridge-like spans forming multiple tiers or levels and flowing ribbons on roadways supported by graceful and aesthetically pleasing columns.

For many years, practitioners in the art of constructing such bridge-like structures, interchanges and overpasses have endeavored to provide a safer working environment for the persons employed in such construction projects. It has been recognized that an element of risk or potential danger exists in such construction projects due to the substantial heights or elevations at which the construction workers must often labor. In addition, as in all commercial enterprises, great pressure also exists to provide efficient and profitable operations. Thus, the challenge has been to find apparatus and procedures which would meet these often competing needs of profitable construction and worker safety. In addition, a variety of government agencies within the United States of America and other industrialized nations have instituted numerous laws and regulations which govern the conduct of construction companies and the activities of construction workers.

Despite the desires of construction companies to maintain a safe work environment and the multiplicity of laws and regulations directed toward safe working conditions, all too often safety or operational profit are compromised in meeting this dual need.

One phase of bridge or overpass construction which often creates an undesirable safety risk occurs once the supporting columns have been fabricated and the operation of building the connecting spans of roadway is undertaken. The process basically involves erecting temporary support structures between the support columns which in turn support a temporary plywood platform or deck upon which the construction workers operate to fabricate the temporary concrete forms used to construct the actual roadway span. Such forms are configured to receive metal reinforcing elements as well as concrete and require a substantial number of laborers and an extended period of operation upon the temporary wooden deck. During temporary wooden deck fabrication, construction workers operating upon the structure are subjected to substantial risk due to high elevation, difficult conditions such as wind or the like, and the unavailability of a convenient or effective safety harness system. During earlier phases of temporary structure erection, workers are able to utilize safety harnesses and safety belts for attachment to a convenient structural element such as a wood or steel beam within the temporary structure as it is raised. Unfortunately, once the installation of the temporary wooden deck is begun, the wooden deck material covers the convenient structural elements preventing attachment of safety lines thereto.

There arises therefore a need in the art for a reliable effective and efficient fall protection system which may be utilized during this critical stage of bridge or overpass construction without unduly encumbering the efficiency of the overall construction operation.

SUMMARY OF THE INVENTION

Accordingly, it is a general object of the present invention to provide an improved fall protection system for bridge construction. It is a more particular object of the present invention to provide an improved fall protection system for bridge construction which is operative and effective during and following the installation of the temporary wooden deck or platform as bridge spans are being fabricated.

In accordance with the present invention, there is provided for use in combination with a plurality of elevated roadway spans being fabricated between spaced apart support columns, a fall protection system comprises: a plurality of cable supports each having a vertical support member coupled to a support column and a horizontal crossbeam extending from the vertical support member transversely with respect to the roadway span; a plurality of cables secured between adjacent horizontal crossbeams; a plurality of safety belt attachments slidably coupled to the cables; and a plurality of safety belts each having one end coupled to the safety belt attachments and the other end securable to a safety harness.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
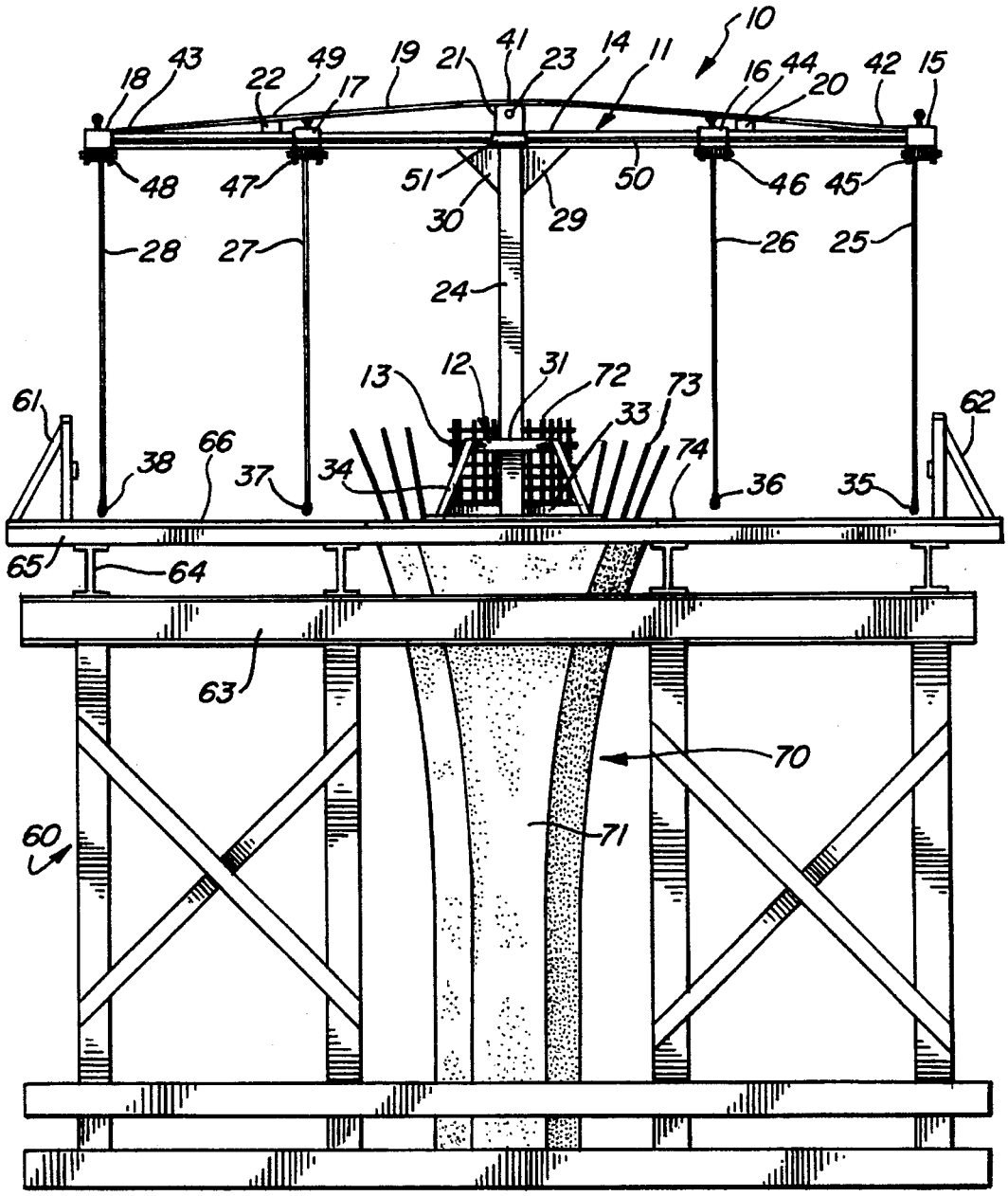
FIG. 1 sets forth an elevation view of a typical bridge or overpass section having the present invention fall protection system.

FIG. 1 sets forth an elevation view of a typical overpass or bridge support column generally referenced by numeral 70 together with a typical temporary span support generally referenced by numeral 60. FIG. 1 also shows a fall protection system during initial installation upon column support 70 constructed in accordance with the present invention and generally referenced by numeral 10. More specifically, FIG. 1 sets forth a support column 70 formed of a concrete pier 71 defining a top surface 74 and supporting a plurality of reinforcement bars 73 together with a reinforcement bar cage 72. In accordance with conventional fabrication techniques, reinforcement bars 73 and reinforcement bar cage 72 extend upwardly beyond top surface of concrete pier 71. This extension of reinforcement bar and cage is provided to engage the concrete span portion of the bridge or overpass which is poured and which rests upon top surface 74. Thus, in accordance with conventional fabrication techniques, reinforcement bars 73 and reinforcement bar cage 72 extend downwardly through concrete pier 71 and are thus securely coupled thereto.

In further accordance with conventional fabrication techniques, a temporary span support 60 is erected between adjacent support columns such as column 70 and its next adjacent column (not shown). Temporary span support 60 terminates in a tier or steel beams 63 extending transversely and a tier or steal beams 64 extending longitudinally with respect to the span under construction. A plurality of wooden beams 65 such as conventional four inch by four inch wood beams are positioned orthogonally to beams 64. A plywood deck 66 is then laid upon and temporarily secured to wooden beams 65.

At the point in the construction process in which temporary wooden deck 66 is to be installed, the present invention fall protection system is then installed using each of the concrete support columns such as column 70. At the point of fall protection system installation shown in FIG. 1, a cable support assembly generally referenced by numeral 11 is installed upon and secured to support column 70. Cable support 11 includes a generally T-shaped member formed of a center support 24 and a crossbeam 14. A pair of braces 29 and 30 are secured to the junction of center support 24 and crossbeam 14 for additional strength. A base member 12 is secured to the lower end of center support 24 and includes a cross member 31 and a bottom plate 32 both secured to center support 24 by conventional welding attachment or the like. Base 12 further includes a pair of angled side braces 33 and 34 secured to the ends of cross member 31 and bottom plate 32. A chain 13 is wrapped about the upper portion of reinforcement bar cage 72 to secure base 12 and center support 24 to the reinforcement bar cage. Alternatively, center support 24 may be secured to support column 70 in the manner set forth in FIG. 5 and described below in greater detail. However, suffice it to note here that in accordance with the present invention, center support 24 is secured to support column 70 in a rigid secure attachment.

Cable support 11 further includes a center spacer 21 secured to the center of crossbeam 14 and extending upwardly therefrom. Center spacer 21 is preferably welded to beam 14 and defines an aperture 23 used in lifting cable support 11 by means of a conventional crane or the like. Cable support 11 further includes an elongated rod 19 secured to each end of crossbeam 14 by weld junctions 42 and 43 and secured to the upper edge of center support 21 by a weld 41. Cable support 11 further includes a pair of spacers 20 and 22 positioned on each side of center support 21 and welded to crossbeam 14. Spacers 20 and 22 are also welded to rod 19 by welds 44 and 49 respectively. The function of rod 19 is to provide additional strength for crossbeam 14. In addition and as is better seen in FIG. 3, crossbeam 14 further includes an additional rod 50 secured to each end of crossbeam 14 by welding attachment and a center spacer 51 similar to center spacer 21 extending outwardly and welded to rod 50. As is also better seen in FIG. 3, crossbeam 14 includes an additional rod 52 similar to rod 50 and a spacer 53 similar to a spacer 51. The combined functions of rods 19, 50 and 52 is to provide additional structural strength for crossbeam 14 without dramatically increasing its weight.

In further accordance with the present invention, a plurality of cable attachment assemblies 15, 16, 17 and 18 are received upon crossbeam 14. The structures of cable attachment assemblies 15 through 18 are set forth below in FIG. 4 in greater detail. However, suffice it to note here that cable attachment assemblies 15 through 18 are received upon crossbeam 14 which defines a generally rectangular cross-section in a sliding attachment which facilitates the lateral movement of cable attachment assemblies 15 through 18 to provide proper positioning thereof. In the position selected in FIG. 1, cable attachment assemblies 15 are generally evenly spaced on either side of center support 24 of cable support 11 and outer cable attachment assemblies 15 and 18 are used to install inside safety rails 61 and 62 secured to temporary deck 66 in accordance with conventional fabrication techniques. Cable attachment assembly 15 includes a cable winch 45 constructed in accordance with conventional fabrication techniques and set forth below in FIG. 4 in greater detail. Winch 45 includes a quantity of cable 25 wrapped upon winch 45 and having a free cable end 35. Similarly, cable attachment assemblies 16, 17 and 18 include corresponding cable winches 46, 47 and 48 supporting cables 26, 27 and 28 each having a free end 36, 37 and 38.

Figures 2, 3:
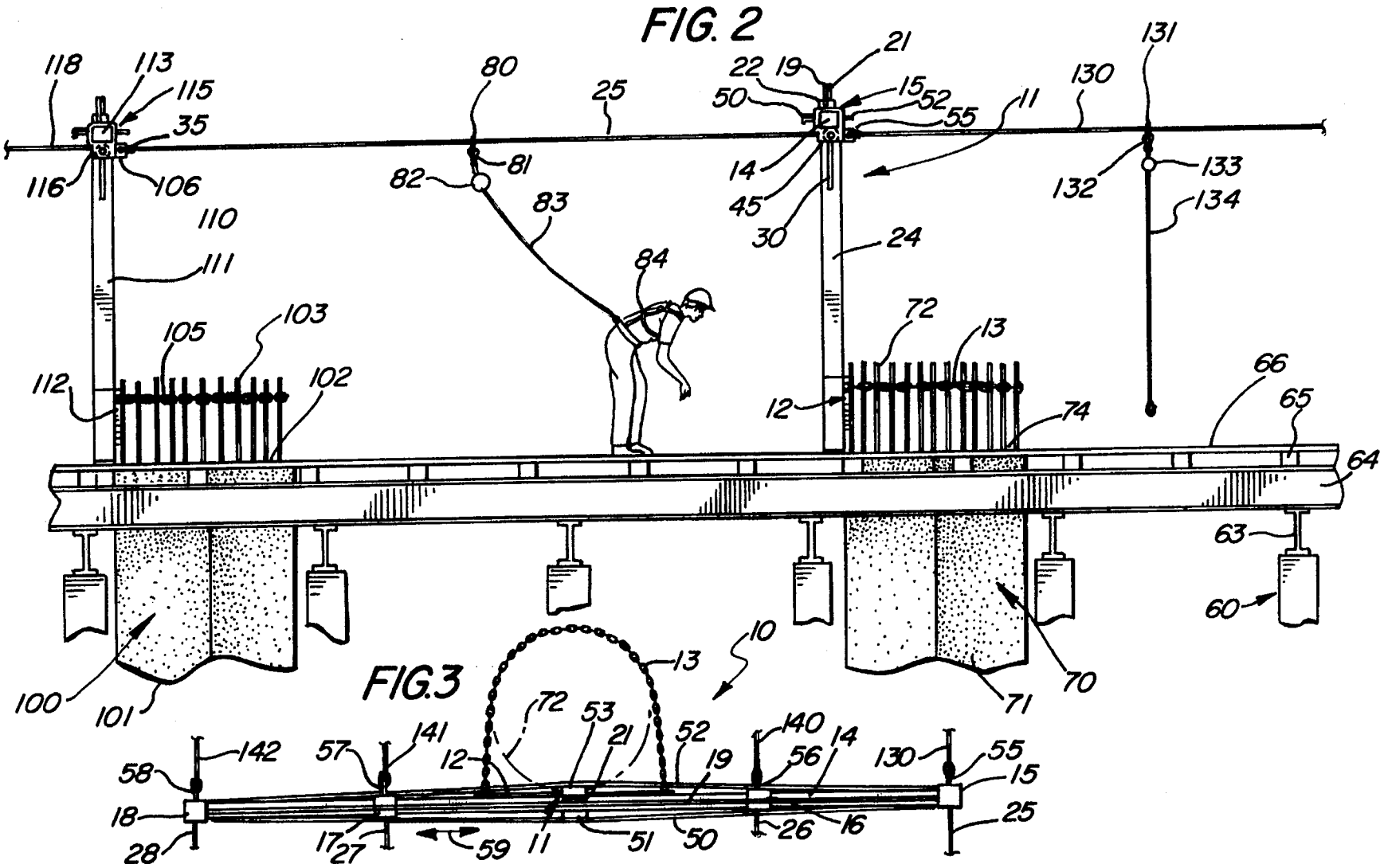
FIG. 2 sets forth a side elevational view of a portion of a typical bridge or overpass having the present invention fall protection system.
FIG. 3 sets forth a top view of a portion of the present invention fall protection system.

At the point of installation of fall protection system 10, cables 25 through 28 have yet to be secured to the adjacent cable support which as is better seen in FIG. 2 is secured to an adjacent support column such as support column 70. With temporary reference to FIG. 2 which shows cable support 11 secured to support column 70 and an adjacent support column 100 having a cable support 110 identical to cable support 11 secured thereto. With further reference to FIG. 2, cable support 110 includes a cable attachment assembly 115 having a cable attachment flange 106 which receives and secures end 38 of cable 28 to couple cable attachment assembly 18 to cable attachment assembly 115. It should be further noted by examination of FIG. 2 that cable attachment assembly 18 includes a cable attachment flange 58 extending forwardly therefrom which receives and secures the cable end of the next adjacent cable support (not shown).

Returning to FIG. 1, it will be understood that following the attachment of base 12 to reinforcement bar cage 72 using chain 13, winches 45 through 48 are operated to release substantial lengths of cables 25 through 28 and thereby facilitate the attachment of cable ends 35 through 38 to the cable attachment assemblies of the next adjacent cable support in the manner shown in FIG. 2 for cable 28 extending between cable supports 11 and 110. It should be further noted that cable attachment assemblies 15 through 18 include forwardly extending cable attachment flanges 55 through 58 respectively which facilitate attachment of the cable ends of the next adjacent cable support in the manner shown in FIG. 2.

It is of particular importance to note that cable support 11 is secured entirely to support column 70 and is independent of temporary span support 60 as well as wooden deck 66. Thus, the entire support for cable support 11 is independent of the temporary support structure and is solely provided by support column 70 together with the attachment of cables 25 through 28 to the adjacent cable support as well as the cable attachments of the next adjacent support, if any, in the opposite direction in the manner shown in FIG. 2. In accordance with the present invention, cable support 11 is however fabricated to provide secure support for cables 25 through 28 when used at the end of string of cable supports.

FIG. 2 sets forth a side elevation view of a fall protection system constructed in accordance with the present invention and generally referenced by numeral 10. FIG. 2 shows a pair of support columns 70 and 100 having concrete piers 71 and 101 and defining top surfaces 74 and 102 respectively. Support column 70 further includes an upwardly extending reinforcement bar cage 72 while support column 100 further includes an upwardly extending reinforcement bar cage 103. As described above, reinforcement bar cages 72 and 103 extend substantially through concrete piers 71 and 101 and as a result are securely attached to support columns 70 and 100 respectively. A temporary span support 60 includes a plurality of supporting steel beams 63 arranged in one direction and beams 64 arranged in a perpendicular arrangement to provide a crossing relationship between steel beams 63 and 64. A plurality of wooden beams 65 are received upon beams 64 and a temporary wooden deck 66 is placed upon and secured to beams 65.

In accordance with the present invention, fall protection system 10 includes a plurality of generally a T-shaped cable supports such as cable supports 11 and 110 secured to adjacent support columns 70 and 100. More specifically, cable support 11 includes a center support 24 secured to reinforcement bar cage 72 by a chain 13 and having a generally trapezoidal base 12 (better seen in FIG. 1) for providing additional attachment of center support 24 upon top surface 74 of concrete pier 71. Cable support 11 further includes a generally rectangular cross-sectioned crossbeam 14 having a plurality of cable attachment assemblies 15 through 18 (cable attachment assemblies 15 through 17 seen in FIG. 1). Crossbeam 14 further includes a plurality of reinforcement rods 19, 50 and 52 as is better seen in FIG. 3. A center bracket 21 extends upwardly from crossbeam 14 and is welded to rod 19. A plurality of spacers such as spacer 22 are positioned upon crossbeam 14 to further secure rod 19. A pair of crossbraces 29 and 30 (the former seen in FIG. 1) are secured between crossbeam 14 and center support 24 for additional strength.

Cable support 110 is identical to cable support 11 and thus includes a center support 111 having a base 112 receiving upon top surface 102 and secured to reinforcement bar cage 103 by a chain 105. Cable support 110 is further identical to cable support 11 in that it includes a crossbeam 113 having a plurality of cable attachment assemblies including a cable attachment assembly 115 generally aligned with cable attachment assembly 18 of cable support 11. Cable attachment assembly 115 includes a conventional winch 116 and supports a cable 118 extending therefrom. It will be understood that cable 118 extends to the left from winch 116 to provide attachment to the next cable support in the system. Cable attachment assembly 115 further includes a cable attachment flange 106 which receives end 38 of cable 28 from cable attachment assembly 18.

In a similar fashion, a cable 130 is secured to cable attachment flange 58 of cable attachment 18. Cable 130 extends from the next adjacent cable support in the rightward direction (not shown).

A cable ring (better seen in FIG. 4) is received upon and slidably movable upon cable 28. A conventional safety clasp 81 supports a conventional belt reel 82 and is removably attached to cable ring 80 in the manner seen in FIG. 4. Belt reel 82 supports a retractable safety belt 83 which in turn is secured at the remaining or free end to a safety harness 84 worn by a construction worker.

In accordance with the present invention, the secure attachment of cable supports 11 and 110 as well as attachment to adjacent cable supports on either side provided by the plurality of overhead cables permits a worker such as that shown in FIG. 2 wearing a safety harness such as harness 84 to be reliably secured to an overhead cable in the manner shown while nonetheless facilitating the easy movement of the construction worker upon the span portion between columns 70 and 100. Thus, the worker shown is protected from falling during operations of installing temporary wooden deck 66 and thereafter due to the limited length of belt 83. At the same time, the worker is able to move freely about the span structure between columns 70 and 100 in a virtually unrestricted field of motion due to the ease with which cable ring 80 slides upon cable 28. As a result, the worker is fully protected against falls in the vertical direction as belt 83, harness 84, clasp 81 and cable ring 80 cooperate to support the worker's weight from cable 28 should the worker fall from the span structure. In accordance with the present invention, the provision of overhead safety cables by the present invention fall protection system provides a secure and safe attachment apparatus which continues to be available notwithstanding the complete covering of beams 65, 64 and 63 by temporary wooden deck 66. It should be further noted that a plurality of cable rings such as cable ring 80 are secured to the remaining cables such as cables 25 through 28 shown in FIG. 1 extending between adjacent cable supports. For example, cable ring 131 is received upon cable 130 and includes a clasp 132, a belt reel 133 and a safety belt 134. It will be appreciated by those skilled in the art that a plurality of similar cable rings and supporting safety belts are secured in most circumstances to the remaining adjacent cables between each span providing a secure safe environment for a plurality of workers.

In accordance with a further important aspect of the present invention, the present invention system's capability of coupling the plural cables from each cable support to adjacent cable supports provides additional strength for the entire fall protection system. Thus, with temporary reference to FIGS. 1 and 2 together, it will be apparent to those skilled in the art that the attachment of cables 25 through 28 to adjacent cable support 110 provides a strengthened attachment in which the plurality of cables cooperate to resist loads imposed upon one cable in the event a worker falls and is suspended from the cable to which the worker is secured. As a result, twisting motions of the T-shaped cable supports are avoided as the plural cables interact to maintain system integrity. It should also be understood that the tension applied to the cables within the present invention system may be readily adjusted by adjusting winches such as winches 45 and 116 shown in FIG. 2.

FIG. 3 sets forth a top view of cable support 11 secured to reinforcement bar cage 72 and having a plurality of cables secured thereto. More specifically, cable support 11 includes a crossbar 14 having a plurality of support rods 19, 50 and 52 secured thereto. Crossbeam 14 further supports a plurality of spacers 21, 51 and 53 secured to rods 19, 50 and 52 respectively. As described above, rods 19, 50 and 52 are welded to crossbeam 14 to provide additional strength and support for the crossbeam. A plurality of cable attachment assemblies 15, 16, 17 and 18 are received upon crossbeam 14 and are slidably movable to adjust the lateral positions of cable attachment assemblies 15 through 18 upon crossbeam 14. Thus, for example, cable attachment assembly 17 may be moved from the position shown in FIG. 3 in either direction as indicated by arrow 59 thereby shifting the attachment points for cables 27 and 141. Cable attachment assemblies 15 through 18 support cables 25 through 28 respectively in the manner described above in FIG. 1. In addition, cable attachment assemblies 15 through 18 support oppositely extending attachment flanges 55 through 58 respectively. As is better seen in FIG. 4, the cable attachment flanges are utilized to secure the cable end from the next adjacent cable support in the manner shown in FIG. 2. In their preferred form, attachment flanges 55 through 58 comprise welded steel plates having cable receiving apertures formed therein. Accordingly, a plurality of cables 130, 140, 141 and 142 are coupled to attachment flanges 55 through 58; it being understood that cables 130, 140, 141 and 142 extend from the next adjacent cable support within the present invention fall protection system. It will be apparent from examining FIG. 3 that the provision of cable attachments in both directions on each side of cable attachment assemblies 15 through 18 greatly strengthens the present invention fall protection system. For example, in the event a person secured to cable 140 should fall and impose a sudden load upon cable 140, the tension in cables 25 through 28 and cables 130, 141 and 142 acting upon crossbeam 14 maintains the position of crossbeam 14 and resists any tendency to twist which would otherwise possibly occur.

Figure 4:
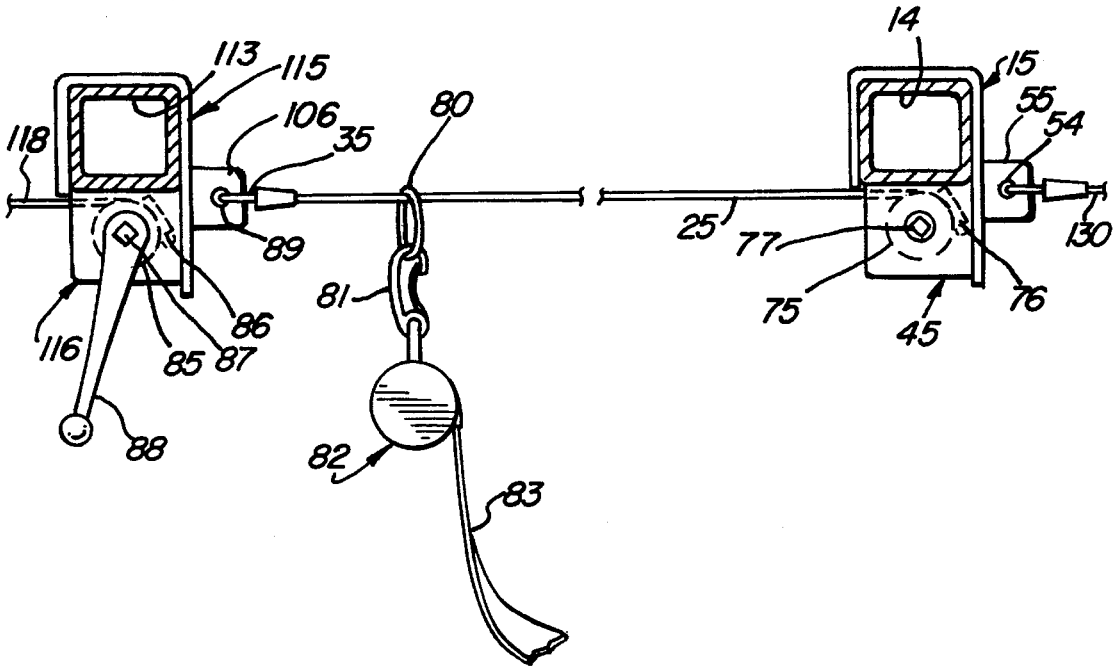
FIG. 4 sets forth a section view of the safety cable support mechanism of the present invention fall protection system.

FIG. 4 sets forth a partial section view of the cable attachment assemblies of adjacent cable supports. More specifically, a crossbeam 14 defines a generally square cross-section having a cable attachment assembly 15 received thereon. As described above, cable attachment assembly 15 is slidably movable upon crossbeam 14 and includes a forwardly extending flange 55 having an aperture 54 formed therein. Cable attachment assembly 15 further supports a conventional cable winch 45 having a rotatable shaft 77 defining a square end and having a ratchet gear 75 rotatable therewith. Winch 45 further includes a conventional spring-biased ratchet pawl 76 which cooperates with ratchet gear 75 in accordance with conventional fabrication techniques. A cable 25 is wound upon winch 45 and defines a cable end 35.

Similarly, a crossbeam 113 defines a square cross-section and supports a cable attachment assembly 115 in a slidable attachment. Cable attachment assembly 115 includes an attachment flange 106 having an aperture 89 formed therein. Cable assembly 15 further supports a conventional cable winch 116 having a ratchet gear 85, a square ended shaft 87 and a ratchet pawl 86 associated therewith. A cable 118 is wound upon winch 116. In the position shown in FIG. 4, cable end 35 of cable 25 is received within aperture 89 and secured therein by conventional fabrication techniques. Similarly, cable 130 which should be understood to extend from the next adjacent cable support (not shown) to the right in the serial arrangement of cable supports is secured to flange 55. Cable 118 should be understood to extend to the left to the next adjacent cable attachment assembly in the serial arrangement of cable supports (not shown).

Thus, in accordance with the present invention a removable handle 88 is temporarily placed Upon square ended shaft 87 and utilized in rotating ratchet gear 85 to draw cable 118 into the desired tension. Thereafter, pawl 86 secures the tension within cable 118 by locking ratchet gear 85 in accordance with conventional fabrication techniques. The user then removes handle 88 from shaft 87 and places it upon square headed shaft 77 of winch 45 and draws cable 25 to the desired tension. This process is repeated throughout the entire fall protection system to properly tension all of the various cables.

In further accordance with the present invention, a cable ring 80 is loosely received upon cable 25 and is easily slidable thereon. Cable ring 80 supports a conventional safety clasp 81 having a belt reel 82 secured thereto. A conventional safety belt 83 is received upon belt reel 82 and is adjustably dispensed therefrom to provide attachment between cable ring 80 and a suitable safety harness such as safety harness 84 shown in FIG. 2. It will be apparent to those skilled in the art that the use of belt reel 82 to vary the length of belt 83 is a matter of convenience and may be eliminated by using a direct coupling between belt 83 and clasp 81 without departing from the spirit and scope of the present invention.

Figure 5:
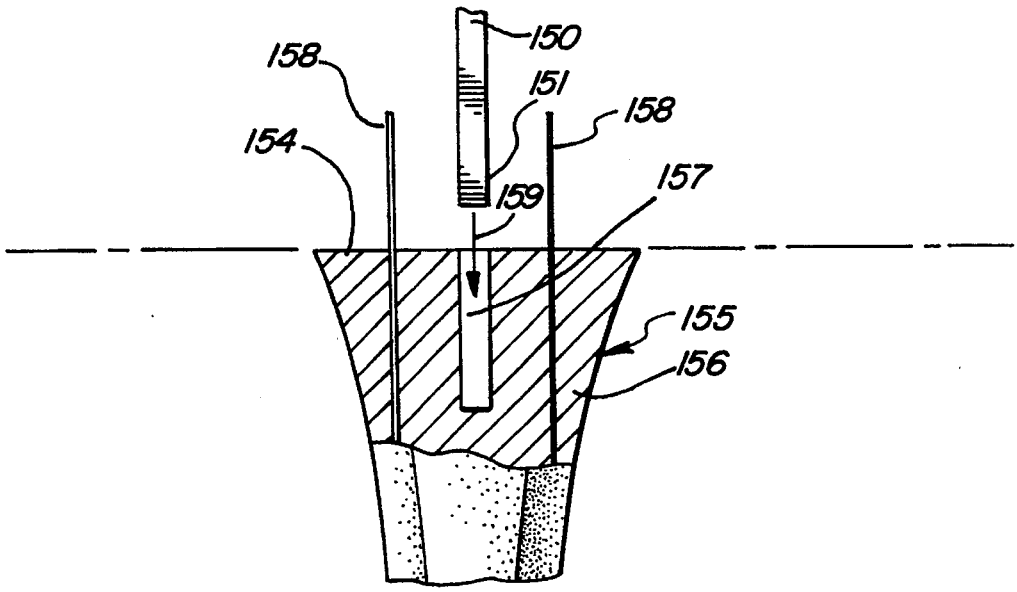
FIG. 5 sets forth a partial section view of an alternate embodiment of the present invention fall protection system.

FIG. 5 sets forth a partial section view of an alternate embodiment of the present invention in which a center support 150 defines an end 151. Center support 150 provides an alternate attachment for a cable support such as cable support 11 which eliminates the need for attachment to the reinforcement bar cage using chains such as chain 13 (seen in FIG. 1). The embodiment shown in FIG. 5 further avoids the need for utilizing base 12 (seen in FIG. 1). Thus, it will be apparent to those skilled in the art that center support 150 is utilized in combination with a crossbeam and the remaining support apparatus as that shown in FIG. 1 for cable support 11. The difference being that end 151 of center support 150 is directly received within a suitable receptacle bore 157 formed in the supporting concrete pier. More specifically, a support column 155 includes a concrete pier 156 defining a closed end bore 157 formed therein. Support column 155 further includes conventional reinforcement bar elements 158 extending upwardly from top surface 154. Thus, in accordance with the present invention, concrete pier 156 is fabricated having bore 157 extending downwardly from top surface 154 by utilizing an appropriately sized elongated plug during the pouring of concrete pier 156. Thereafter, the elongated plug is removed leaving bore 157 formed within concrete pier 156 in the manner shown. The use of bore 157 in cooperation with end 151 of center support 150 greatly improves the attachment of the cable support to support column 155. Thus, center support 150 is secured by simply placing end 151 into bore 157 and allowing end 151 to bottom out in bore 157.

Thus, the embodiment of FIG. 5 utilizes the formation of concrete piers within the support columns which include a bore such as bore 157. Once the present invention fall protection system is no longer needed, center support 150 is removed from bore 157 and additional concrete is poured into bore 157 and suitably compacted therein to close bore 157.

What has been shown is an improved fall protection system for bridge construction in which a plurality of generally T-shaped cable supports are secured to the support columns to provide a plurality of overhead safety cables for use in fabricating the intervening span portions of the bridge or overpass. The system utilizes a plurality of cable tensioners to maintain appropriate cable tension and to accommodate varying distances between support columns in the system.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a plurality of elevated roadway spans being fabricated between spaced apart support columns, a fall protection system comprising:

a plurality of cable supports each having a vertical support member coupled to a support column and a horizontal crossbeam extending from said vertical support member transversely with respect to the roadway span;

a plurality of cables secured between adjacent horizontal crossbeams;

a plurality of safety belt attachments slidably coupled to said cables; and a plurality of safety belts each having one end coupled to said safety belt attachments and the other end securable to a safety harness.

2. A fall protection system as set forth in claim 1 wherein said vertical support member and said horizontal crossbeam form a generally T-shaped support structure.

3. A fall protection system as set forth in claim 2 further including a plurality of adjustable cable attachment assemblies received upon said horizontal crossbeam.

4. A fall protection system as set forth in claim 3 wherein said adjustable cable attachment assemblies each include:

a cable winch having an end of a cable windable thereon; and a cable attachment flange for receiving a cable end, said adjustable cable attachment assemblies each having a first cable extending from said winch to the cable attachment flange of the next adjacent adjustable cable attachment assembly.

5. A fall protection system as set forth in claim 4 wherein said adjustable cable attachment assemblies are slidably movable upon their respective horizontal crossbeams.

6. A fall protection system as set forth in claim 5 wherein said support columns each include a plurality of extending reinforcement bars and wherein said cable supports each include a chain secured to said vertical support member and encircling at least some of said reinforcement bars.

7. A fall protection system as set forth in claim 5 wherein said support columns each include a concrete pier having a top surface and a closed end bore extending downwardly from said top surface and wherein said vertical support member includes a bottom end portion receivable within said bore.

8. A fall protection system as set forth in claim 7 wherein said plurality of adjustable cable attachment assemblies is an equal number evenly divided on each side of said horizontal crossbeam with respect to said vertical support member.

9. A fall protection system as set forth in claim 6 wherein said plurality of adjustable cable attachment assemblies is an equal number evenly divided on each side of said horizontal crossbeam with respect to said vertical support member.

10. For use in combination with a plurality of elevated roadway span support columns during span construction, a fall protection system comprising:

a plurality of generally T-shaped cable supports secured to each of a plurality of adjacent columns;

a plurality of cables secured between said cable supports; and a plurality of safety belts slidably coupled to said cables.

* * * * *